US005492498A

United States Patent [19]

Casillas et al.

[11] Patent Number: 5,492,498

[45] **Date of Patent: *Feb. 20, 1996**

[54] MULTI-PIECE SANDING WHEEL

[75] Inventors: Abel R. Casillas, Los Angeles; Jose R. Gutierrez, Long Beach; Frederick C. Schneider, III, Palos Verdes Estates, all of Calif.

[73] Assignee: The Visser Irrevocable Trust 1992-1, Englewood, Colo.

[ * ] Notice: The term of this patent shall not extend beyond the expiratin date of Pat. No. 5,380,239.

[21] Appl. No.: 370,484

[22] Filed: Jan. 9, 1995

Related U.S. Application Data

[63] Continuation of Ser. No. 72,370, Jun. 4, 1993, Pat. No. 5,380,239, which is a continuation of Ser. No. 839,791, Feb. 21, 1992, abandoned.

[51] Int. Cl.[6] ..... B24D 9/04

[52] U.S. Cl. ..... 451/496; 451/498; 451/538; 451/539; 451/59

[58] Field of Search ..... 451/496, 497, 451/498, 513, 526, 533, 538, 539, 58, 59, 541, 542, 543, 548

[56] References Cited

U.S. PATENT DOCUMENTS

| | | | |
|---|---|---|---|
| 2,720,064 | 10/1955 | Klug | 51/365 |
| 2,778,167 | 1/1957 | Klumpp | 51/364 |
| 3,418,764 | 12/1968 | Kozar | 451/497 |
| 4,437,269 | 3/1984 | Shaw | 51/407 |
| 5,380,239 | 1/1995 | Casillas et al. | 451/496 |

FOREIGN PATENT DOCUMENTS

| | | | |
|---|---|---|---|
| 450529 | 9/1927 | Germany | 51/366 |

*Primary Examiner*—Bruce M. Kisliuk
*Assistant Examiner*—Eileen P. Morgan
*Attorney, Agent, or Firm*—W. Scott Carson

[57] ABSTRACT

A multi-piece sanding wheel having two sanding members mounted about peripheral portions of a disc-shaped support member that is secured to a drive means. Each sanding member includes a C-shaped backing portion with a sanding strip removably secured about its outer periphery. The sanding strip also has two end sections which are respectfully secured over the ends of the C-shape. In operation, the C-shaped backing portions are attached to the disc-shaped support member with the ends of the two C-shapes substantially adjacent to one another and preferably pinching the end sections of the sanding strips therebetween. The disc-shaped support member of the sanding wheel is separately and removably attached to the drive means wherein the sanding members can be removed from the support member without having to disconnect the support member from the drive means. In this manner, the sanding strips and backing portions can both be easily and quickly removed and replaced, all without having to disconnect the drive means.

26 Claims, 3 Drawing Sheets

Fig. 1
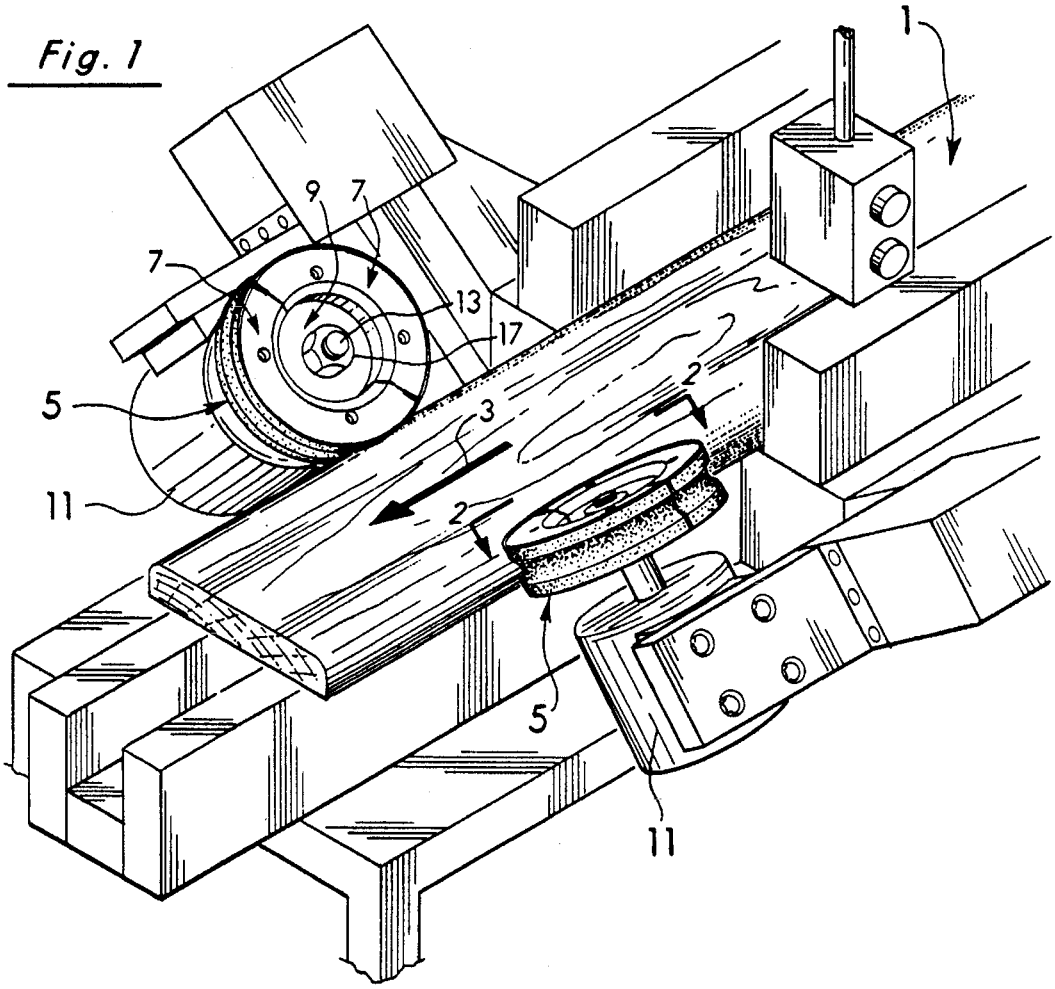
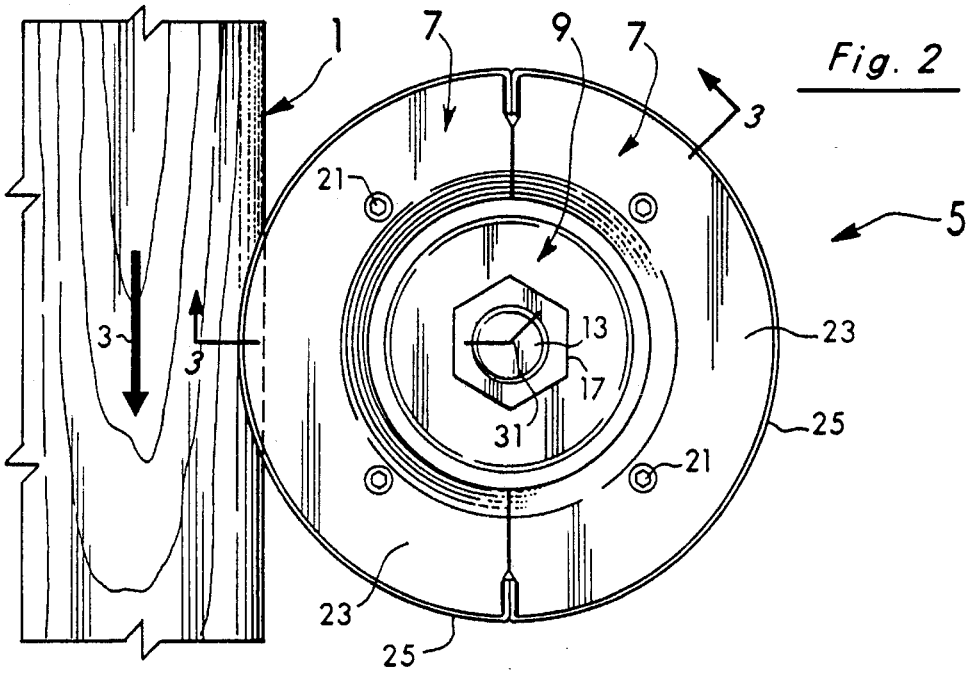
Fig. 2

MULTI-PIECE SANDING WHEEL

This is a continuation divisional of application Ser. No. 72,370, filed Jun. 4, 1993, now U.S. Pat. No. 5,380,239, which is a continuation of Ser. No. 791 filed Feb. 21, 1992, now abandoned.

BACKGROUND OF THE INVENTION

1. Field of the Invention

This invention relates to the field of sanding apparatus and more particularly, to the field of multi-piece sanding wheels.

2. Discussion of the Background

Sanding wheels are widely used in a number of industrial applications to finish wood and other materials. In a typical operating setup, the sanding wheel is mounted on a drive motor and rotated about an axis as the piece to be worked is moved by it. The sanding wheel itself may be of any number of designs including single and multi-piece ones. In single piece designs, the sanding element and its backing portion are simply combined into an integral unit. In multi-piece designs, a common approach is to have a sanding member which includes a sanding strip and a contoured or profiled backing portion wherein the strip is positioned about the periphery of the backing portion. The planar or flat strip then assumes the profile of its backing portion. Alternately, the sanding strip itself can be contoured and mounted about a non-profiled backing portion.

In high volume operations, it is critical that the design of the sanding wheel not only permit its sanding element (e.g., a strip of sandpaper) to be easily and quickly removed and replaced once it is worn but also permit the backing portion or portions to be quickly and easily removed and replaced. That is, in large volume operations, downtime to replace worn sanding elements or to replace one profiled backing portion with another is absolutely crucial to a successful and efficiently run shop. In this regard and if the sanding station is simply one in a line of operations, then essentially the entire assembly or processing line must be shut down while the changes are made to the sanding wheels. Current sanding wheels do not permit quick changeouts and in particular, do not permit a quick change of a worn sanding element on a wheel or a quick change of one profiled backing portion for another.

For example, with the design of U.S. Pat. No. 4,870,787 to Voorhees which uses a continuous sanding strip, the strip can only be changed by loosening the entire wheel from its drive, separating the top and bottom halves of the wheel, inserting the sanding strip between the halves, and then re-tightening the halves together and onto the drive. The downtime to do such a change is obviously quite substantial particularly since the entire sanding wheel must be removed from its drive each time the sanding strip is changed or a new profile is needed.

In a companion U.S. Pat. No. 4,744,180, Voorhees discloses a sanding wheel in which his continuous sanding strip can be replaced without removing the entire wheel from its drive. However, even this method involves a time consuming and elaborate operation of threading a continuous sanding strip through a slot in circumferential lips extending about the wheel. It further involves securing the strip ends in place with a spring-biased clamp projecting outwardly from the main body of the wheel. Additionally, like his earlier patent, Voorhees' design requires that the wheel be disconnected from its drive to change out the backing portions for the sanding strip should different backing portions be desired or necessary. In a similar design of Larick Machinery, Inc., a continuous sanding strip with one part of a hook-loop fastener on its back is removably secured about a substantially cylindrical, backing portion which has the mating part of the hook-loop fastener about its periphery. However, to secure the ends of the strip on the backing portion, a large notch or gap is provided in the periphery of the backing portion into which the ends of the strip must be manually inserted. This notch is understandably rather large and creates a very undesirable gap in the otherwise continuous sanding periphery of the wheel. Additionally, the process of manually inserting the ends of the strip into the notch not only is time consuming but also creates bends or folds in the sanding strip which easily fatigue and break in use. Also, to replace the backing portion of the sanding strip (e.g., to go to a different profile), the drive must be disconnected from the backing portion and reconnected to the new backing portion resulting in significant downtime.

With the above background in mind, the multi-piece sanding wheel of the present invention was developed. With it, the sanding elements or strips can be easily and quickly removed and replaced without disconnecting the drive from the wheel. Additionally, the backing portions for the sanding strips can also be easily and quickly removed and replaced without disconnecting the drive from the wheel. In this manner, undesirable downtime to change worn sanding strips or to change profiles is significantly reduced.

SUMMARY OF THE INVENTION

This invention in its preferred embodiment involves a multi-piece sanding wheel having two sanding members mounted about peripheral portions of a disc-shaped support member that is secured to a drive means. Each sanding member includes a C-shaped backing portion with a sanding strip removably secured about its outer periphery. The sanding strip also has two end sections which are respectfully secured over the ends of the C-shape. In operation, the C-shaped backing portions are attached to the disc-shaped support member with the ends of the two C-shapes substantially adjacent to one another and preferably pinching the end sections of the sanding strips therebetween. This arrangement not only helps to hold the strips in place but also serves to make the sanding surface of the wheel virtually continuous about its periphery by essentially eliminating any gap between the strips. The disc-shaped support member of the sanding wheel is separately and removably attached to the drive means in such a manner that the sanding members can be removed from the support member without having to disconnect the support member from the drive means. In this manner, the sanding strips and backing portions can both be easily and quickly removed and replaced, all without having to disconnect the drive means.

BRIEF DESCRIPTION OF THE DRAWINGS

FIG. 1 is a perspective view of a pair of the multi-piece sanding wheels of the present invention in a typical operating setup.

FIG. 2 is a view taken along line 2—2 of FIG. 1.

DETAILED DESCRIPTION OF THE PREFERRED EMBODIMENTS

FIG. 1 illustrates a typical operating setup in which the board 1 is being moved from right to left in the direction of arrow 3 past the pair of sanding wheels 5. The pair of sanding wheels 5 as shown are positioned to finish or sand the opposite edges of the board 1. In a normal operation, the edges of the board 1 would have already been rough cut into a desired profile by shaping or coping heads (not shown) upstream of the sanding station of FIG. 1. At the sanding station of FIGS. 1 and 2, the rough cut edges of the board 1 are then sanded to a smooth finish as the board 1 is moved past the sanding wheels 5.

Figure 3:
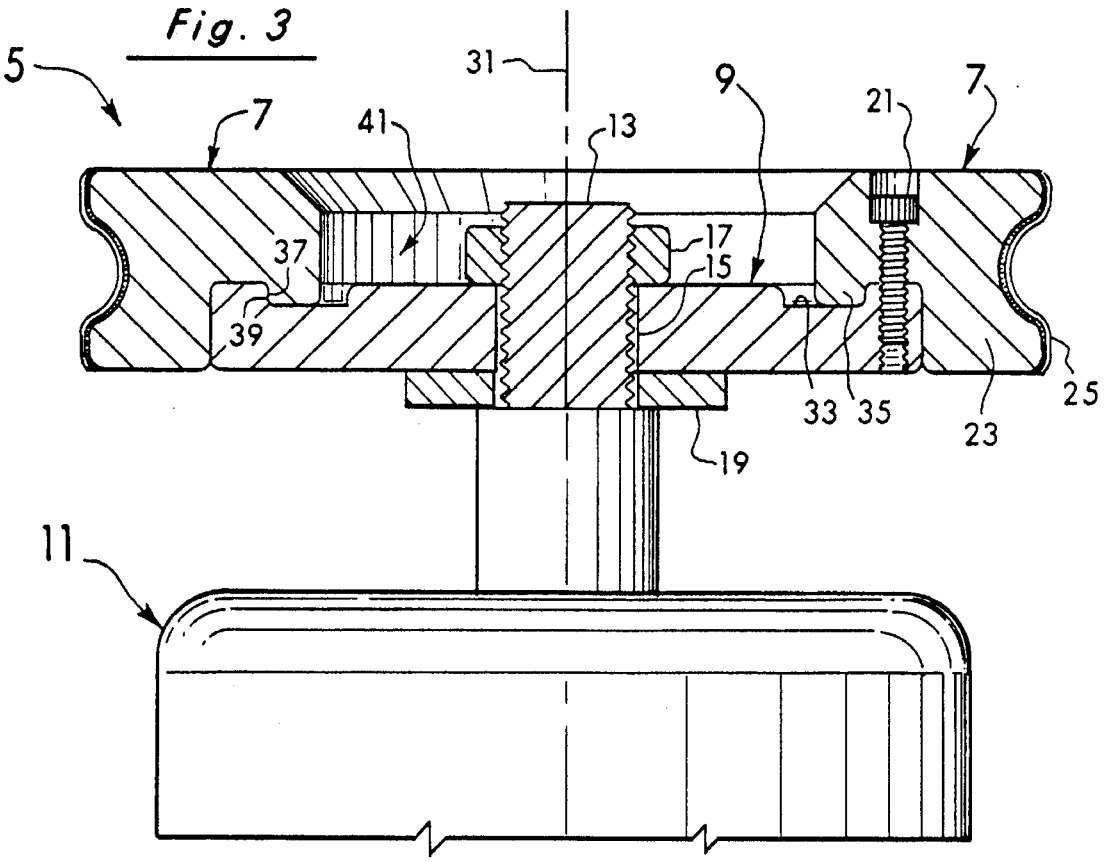
FIG. 3 is a view taken along line 3—3 of FIG. 2.
Figure 4:
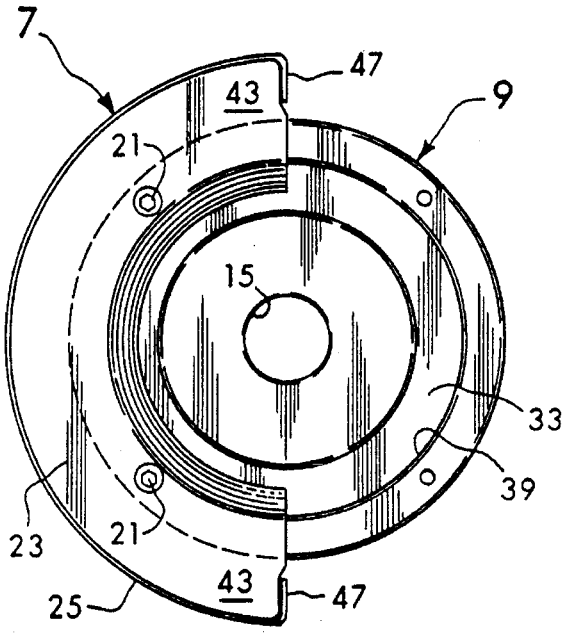
FIG. 4 is a top plan view of the disc-shaped support member of the multi-piece sanding wheel with one of the C-shaped sanding members of the sanding wheel attached to it.
Figure 5:
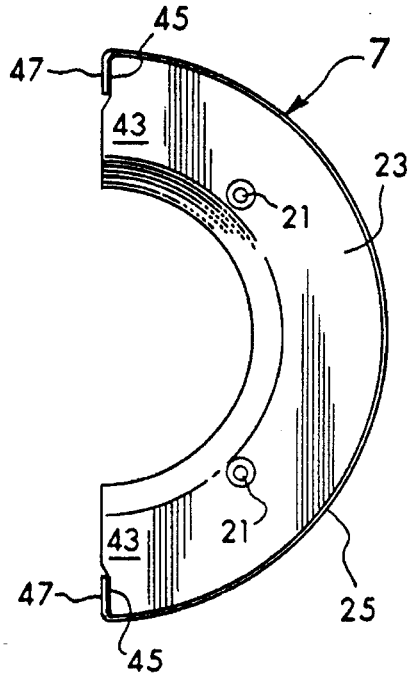
FIG. 5 is a top plan view of the other sanding member by itself.

Each sanding wheel 5 as best seen in FIG. 3–5 preferably includes two, C-shaped sanding members 7 (see FIGS. 4 and 5) and a disc-shaped support member 9 which is mounted to a drive means 11 (see FIG. 3). The disc-shaped support member 9 can be mounted on the drive shaft 13 of the drive means 11 in any number of manners. However, as shown, it is removably secured about the drive shaft 13 with the threaded shaft 13 extending through the central hole 15 of the disc-shaped support member 9 and the support member 9 secured between the nut 17 and backing washer 19. The C-shaped sanding members 7 are, in turn, removably secured to peripheral portions of the disc-shaped support member 9 by Allen screws 21 or other suitable means.

Figure 6:
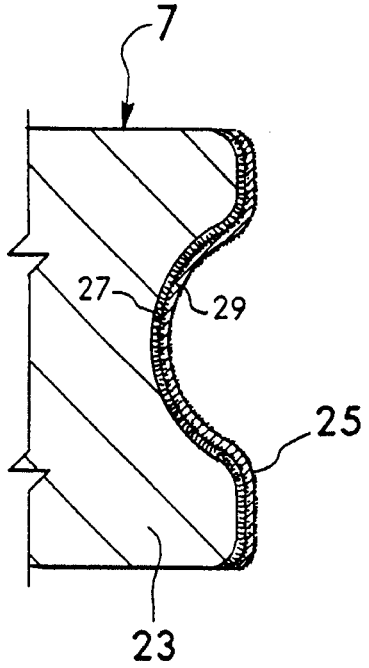
FIG. 6 is an enlarged view of the periphery of one of the sanding members showing its profiled, backing portion and the sanding strip which is removably secured to it preferably by a hook-loop fastener.

The sanding members 7 preferably have C-shaped backing portions 23 (see FIGS. 4 and 5) about which the sanding strips 25 are removably secured by a hook-loop fastener or other arrangement. In this regard as shown in FIG. 6, the periphery of the C-shaped backing portion 23 preferably has one part 27 of the hook-loop fastener on it while the back of the sanding strip 25 has the mating part 29 of the hook-loop fastener on it.

In operation and with the C-shaped sanding members 7 secured by screws 21 to disc-shaped support member 9 (in predetermined, fixed positions relative to the support member 9 and to each other) and the support member 9, in turn, separately secured to the drive shaft 13 of the drive means 11, the shaft 13 with the attached support member 9 and sanding members 7 is then rotated about the axis 31 (see FIG. 3). As shown, the sanding members 7 remain in their predetermined, fixed positions relative to the support member 9 and to each other not only in use when the drive means 11 is rotating the sanding wheel 5 and the sanding wheel 5 is abutting and sanding the board 1 but also when the drive means 11 and sanding wheel 5 are still. To change out a worn sanding strip 25, one or preferably both C-shaped sanding members 7 can be easily and quickly removed from the support member 9 by simply unscrewing screws 21. The exposed sanding strips 25 are then peeled off the ends and outer periphery of each C-shaped backing portion 23 and replaced with new ones. Alternately, and to save even more time, a completely different pair of C-shaped sanding member 7 can be standing by with fresh strips 25 on them. In either case, the sanding members 7 are then easily and quickly re-secured to the disc-shaped support member 9 with screws 21, all without having to disconnect the disc-shaped support member 9 of the sanding wheel 3 from its drive means 11. As shown in the cross-sectional views of FIGS. 3 and 6, the backing portions 23 are lined for and preferably made of metal wherein the sanding members 7 are then relatively rigid and inflexible. In this manner as illustrated in FIGS. 1–7, each sanding member 7 has a predetermined, fixed shape and maintains this shape in use to give the board or other workpiece 1 the desired profile of FIGS. 3 and 6. Once the sanding wheel 5 is assembled as illustrated, the sanding members 7 together form a substantially continuous sanding surface 25 (see FIG. 2) about the axis 31. This sanding surface 25 assumes a first shape (e.g., circular about the axis 31 with the profile of FIGS. 3 and 6) and this first shape remains the same whether the sanding wheel 5 is still or being rotated by the drive means 11 with the sanding wheel 5 abutting and sanding the board or other workpiece 1.

To aid in aligning and securing the sanding members 7 to the support member 9, the support member 9 and sanding members 7 are provided with a groove 33 and projection 35 arrangement (see FIGS. 3 and 4). The mating groove 33 and projections 35 help to quickly and precisely align the members 7 and 9. Additionally, the groove 33 and projections 35 and in particular the abutting surfaces 37 and 39 which are preferably parallel to each other and to the axis 31 aid the screws 21 in securing and holding the members 7 and 9 in place as the sanding wheel 5 is rotated. The groove 33 as shown extends about the axis 31 with the projections 35 of the two sanding members 7 then each extending substantially 180 degrees about the axis 31.

In the preferred embodiment, there are two, C-shaped sanding members 7 with each member 7 having an outer, sanding surface 25 extending substantially 180° about the rotational axis 31 (see FIG. 2). In this manner and with the sanding members 7 secured to the support member 9, the sanding surfaces 25 of the two sanding members 7 together form a substantially continuous sanding surface about the axis 31. As shown, each of the C-shaped sanding members 7 is actually part or half of an annular ring forming and defining a circular opening 41 (see FIG. 3) about the end of the shaft 13 and the nut 17. The C-shaped sanding members 7 are then removably secured by screws 21 to peripheral portions of the support member 9 at locations about the axis 31 spaced radially outwardly of the opening 41. In this manner, the sanding wheel 5 composed of members 7 and 9 can be removed as a unit from the drive means 11 if desired by simply unscrewing nut 17 which is dimensioned to fit within the opening 41. However, since the disc-shaped support member 9 is separately and removably secured to the drive means 11, the operator has the option of removing the sanding members 7 from the disc-shaped support member 9 while maintaining the support member 9 secured to the drive means 11. This is the preferred mode of operation wherein the support member 9 remains secure to the drive means 11 when one or both of the sanding members 7 are removed to save valuable downtime by not having to disconnect the drive means 11.

Figure 7:
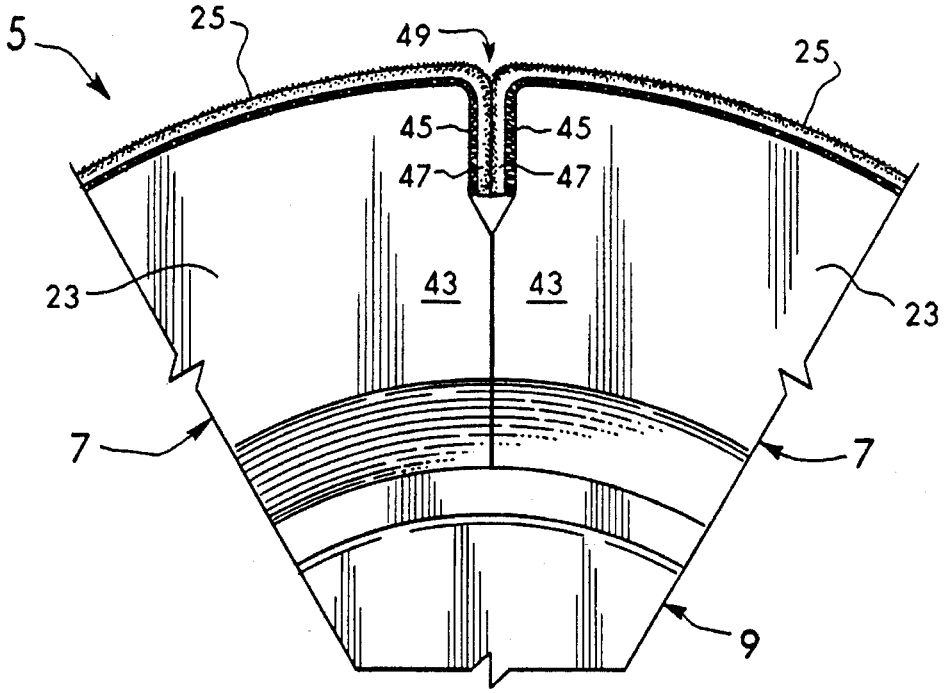
FIG. 7 is an enlarged view of the manner in which the C-shaped backing portions of the sanding members are mounted on the disc-shaped support member with the end sections of the respective sanding strips substantially pinched between the adjacent ends of the C-shaped backing portions.

Referring to the enlarged view of FIG. 7, the corresponding ends 43 of each C-shaped backing portion 23 are preferably positioned adjacent one another when they are secured to the support means 9. Each end 43 of the preferred embodiment includes a planar surface 45 which extends substantially radially outwardly of the axis 31. The end sections 47 of each sanding strip 25 (see FIG. 5) are then positioned to extend over at least a portion of the respective surfaces 45. The C-shaped backing portions 23 and sanding strips 25 with the hook-loop fastener parts on them and are all dimensioned in this regard so that the end sections 47 of the sanding strips 25 are substantially pinched between the parallel surfaces 45 as shown in FIG. 7. This not only helps to hold the strips 25 in place but also serves as shown in FIG. 7 to significantly reduce and nearly eliminate any gap at 49 between the strips 25. In this manner, the sanding surface about the entire periphery of each sanding wheel 5 is virtually continuous.

While several embodiments of the invention have been shown and described in detail, it is to be understood that various modifications and changes could be made to them without departing from the spirit of the invention. For example, the invention has been shown and described with the sanding members 7 having outer, sanding surfaces formed by removable sanding strips 25, however, the sanding surfaces could be integrally formed on the backing portions 23 if desired. Sanding members 7 are also shown and described as being two, substantially identical C-shaped or arcuate members for simplicity of design and assembly; but, the annular ring or other arrangement formed by them could be divided into any number of a plurality of identical or non-identical sanding members which were attached individually or collectively to the support member. The sanding members, however, would still preferably be removable from the support member without having to disconnect the drive means. Also, the backing portions 23 are shown and described as being profiled with non-planar outer surfaces but they alternately could simply be flat or non-profiled with the strips 25 then being either profiled or planar depending upon the particular application.

We claim:

1. A multi-piece sanding wheel primarily intended for sanding a workpiece, said multi-piece sanding wheel including:

at least two separable, sanding members respectively having a predetermined, fixed shape and maintaining said predetermined, fixed shape in use, support means, drive means for rotating said support means about an axis, means for removably securing said support means to said drive means, first means for removably securing a first of said at least two separable sanding members to said support means in a predetermined, fixed position relative to said support means while said support means is secured to said drive means, and second means for removably securing a second of said at least two sanding members to said support means in a predetermined, fixed position relative to said support means and to said first sanding member while said support means is secured to said drive means, said first and second securing means being operably distinct from each other wherein one of said first and second sanding members can be removed from being secured to said support means while the other of said first and second sanding members remains secured to said support means in said fixed position relative to support means, each of said sanding members having an outer, sanding surface extending partially about said axis wherein said sanding surfaces together form a substantially continuous sanding surface about said axis when said sanding members are secured to said support means, said substantially continuous sanding surface assuming a first predetermined, fixed shape when said drive means is not rotating and maintaining said first predetermined, fixed shape in normal use when said drive means is rotating said sanding wheel and said sanding wheel is abutting and sanding said workpiece.

2. The multi-piece sanding wheel of claim 1 wherein said first and second sanding members have outer, sanding surfaces with each sanding surface extending substantially 180 degrees about said axis and said sanding surfaces together forming said substantially continuous sanding surface about said axis when said first and second sanding members are secured to said support means.

3. The multi-piece sanding wheel of claim 2 wherein each of said first and second sanding members includes a backing portion, a sanding strip, and means for removably securing said sanding strip to said backing portion.

4. The multi-piece sanding wheel of claim 3 wherein the backing portion of each of said first and second sanding members forms half of a substantially annular ring about said axis with each half being substantially C-shaped with the corresponding ends of the C-shaped backing portions positioned substantially adjacent one another when said first and second sanding members are secured to said support means.

5. The multi-piece sanding wheel of claim 4 wherein each end of said C-shaped backing portions has a surface extending substantially outwardly of said axis when said first and second sanding members are secured to said support means with the corresponding outwardly extending surfaces being substantially adjacent one another when said first and second sanding members are secured to said support means.

6. The multi-piece sanding wheel of claim 5 wherein said surfaces on the ends of said C-shaped backing portions extend substantially radially outwardly of said axis when said first and second sanding members are secured to said support means.

7. The multi-piece sanding wheel of claim 5 wherein said corresponding outwardly extending surfaces are substantially parallel to one another when said first and second sanding members are secured to said support means.

8. The multi-piece sanding wheel of claim 5 wherein each of said outwardly extending surfaces is substantially planar.

9. The multi-piece sanding wheel of claim 1 wherein each of said sanding members includes a backing portion, sanding strip, and means for removably securing said sanding strip to said backing portion.

10. The multi-piece sanding wheel of claim 9 wherein said means for removably securing said sanding strip includes a hook and loop fastener with the hook portion of said fastener attached to one of the backing portions and the sanding strip and the loop portion attached to the other of the backing portion and the sanding strip.

11. The multi-piece sanding wheel of claim 1 wherein said support means includes a substantially disc-shaped member with a hole through the center thereof, said drive means includes a shaft receivable through the hole in said disc-shaped member, means for removably securing said disc-shaped member to said shaft with said shaft extending through said hole, and means for rotating said shaft and disc-shaped member secured thereto about said axis.

12. The multi-piece sanding wheel of claim 11 wherein said disc-shaped member has peripheral portions spaced from and extending about said axis when said disc-shaped member is secured to said shaft and said means for removably securing each of said plurality of sanding members to said support means secures each sanding member to a peripheral portion of said disc-shaped member at a location spaced from said axis.

13. The multi-piece sanding wheel of claim 1 wherein said support means has peripheral portions spaced from and extending at least partially about said axis when said support means is secured to said drive means and said means for removably securing each of said plurality of sanding members to said support means secures said sanding members to said peripheral portions at locations spaced from said axis.

14. The multi-piece sanding wheel of claim 13 further including a groove and mating projection arrangement to help align the sanding members on the support means, said support means including one of said groove and mating projection arrangement and said sanding members including the other of said groove and mating projection arrangement, said groove and projection arrangement extending substantially about said axis and including surfaces substantially parallel to each other and to said axis, said surfaces substantially abutting each other about said axis when said sanding members are secured to said support means.

15. The multi-piece sanding wheel of claim 1 wherein each of said plurality of sanding members is a portion of a substantially annular ring spaced from and extending about said axis when said sanding members are secured to said support means to form and define an opening about said axis, said means for removably securing said support means to said drive means including means dimensioned to fit within said opening.

16. The multi-piece sanding wheel of claim 15 wherein said means for removably securing each of said plurality of sanding members to said support means secures each sanding member thereto at a location spaced from said axis radially outwardly of said opening.

17. The multi-piece sanding wheel of claim 1 wherein said outer, sanding surfaces of said sanding members are profiled, non-planar surfaces.

18. The multi-piece sanding wheel of claim 1 wherein each of said sanding members includes a backing portion with a profiled, non-planar surface, a sanding strip, and means for removably securing said sanding strip to said backing portion.

19. The multi-piece sanding wheel of claim 1 wherein said at least two separable sanding members are relatively rigid and inflexible.

20. A method for removably securing sanding members of a multi-piece sanding wheel to a drive means for rotation about an axis, said method including the steps of:

(a) providing at least two separable, sanding members, support means, and drive means for rotating said support means about an axis, (b) securing said support means to said drive means for rotation about said axis, and thereafter (c) separately securing each of said separable sanding members to said support means in respective predetermined, fixed positions relative to said support means and to each other while maintaining said support means of step (b) secured to said drive means, each of said separable sanding members having an outer, sanding surface extending partially about said axis wherein said sanding surfaces together form a substantially continuous sanding surface about said axis, said sanding surface having a first predetermined, fixed shape when said drive means is not rotating said support means and said sanding members secured thereto, and (d) operating said drive means to rotate said support means and sanding members secured thereto with said sanding members abutting and sanding a workpiece and with said substantially continuous sanding surface maintaining said first predetermined, fixed shape.

21. The method of claim 20 further including the step of:

e) removing a first of said at least two separable sanding members from said support means while maintaining said support means secured to said drive means and while maintaining at least a second of said separable sanding members secured to said support means.

22. The method of claim 21 further including the step of:

(f) replacing said removed first sanding member with a different sanding member and securing said different sanding member to said support means while maintaining said support means secured to said drive means and while maintaining at least said second sanding member secured to said support means.

23. The method of claim 20 wherein each of said plurality of separable sanding members is a part of a substantially annular ring spaced from and extending about said axis, each such part having ends wherein step (c) includes the further limitation of securing said annular ring parts to said support means with the corresponding ends of said annular ring parts substantially adjacent one another.

24. The method of claim 20 wherein said support means has peripheral portions spaced from and extending at least partially about said axis when said support means is secured to said drive means in step (b) and step (c) includes the further limitation of securing each of said separable sanding members to a peripheral portion of said support means at a location spaced from said axis while maintaining said support means secured to said drive means.

25. The method of claim 20 wherein each sanding member has a backing portion, sanding strip, and means for removably securing said sanding strip to said backing portion.

26. The method of claim 20 wherein said at least two separable sanding members are relatively rigid and inflexible.

* * * * *